United States Patent [19]

Mishima et al.

[11] 4,318,735

[45] Mar. 9, 1982

[54] PROCESS FOR PREPARING MAGNETIC PARTICLES WITH METALLIC REGION THEREIN, AND MAGNETIC PARTICLES PREPARED BY THE PROCESS

[75] Inventors: Akio Mishima; Hiroyuki Kondo; Akira Mukaizaka, all of Hiroshima, Japan

[73] Assignee: Toda Kogyo Corp., Hiroshima, Japan

[21] Appl. No.: 157,115

[22] Filed: Jun. 6, 1980

[30] Foreign Application Priority Data

Jun. 18, 1979 [JP] Japan ..... 54-77301
Sep. 29, 1979 [JP] Japan ..... 54-125926

[51] Int. Cl.[3] ..... H01F 1/09; H01F 1/33

[52] U.S. Cl. ..... 75/0.5 BA; 148/6.35; 148/105; 148/31.5

[58] Field of Search ..... 75/0.5 AA, 0.5 BA; 148/105, 6.35, 31.5

[56] References Cited

U.S. PATENT DOCUMENTS

| | | | |
|---|---|---|---|
| 2,853,407 | 9/1958 | Rogers | 148/6.35 |
| 3,120,698 | 2/1964 | Elliot | 148/105 |
| 3,767,477 | 10/1973 | McCabe et al. | 148/6.35 |
| 4,158,561 | 6/1979 | Pavlik et al. | 148/105 |

FOREIGN PATENT DOCUMENTS 52-54998 5/1977 Japan .

*Primary Examiner*—W. Stallard
*Attorney, Agent, or Firm*—Wegner & Bretschneider

[57] ABSTRACT

Fine magnetic particles with high saturation magnetization (over 140 emu/g) as well as high stability against oxidation in air, are produced by a process which comprises the first stage of oxidizing the surfaces of metallic particles consisting mainly of iron in an atmosphere containing both $H_2O$ and $H_2$ gases at an oxidizing temperature below 900° C., and the second stage of further oxidizing the surfaces of the particles produced at the first stage in an atmosphere containing $O_2$ gas.

22 Claims, No Drawings

PROCESS FOR PREPARING MAGNETIC PARTICLES WITH METALLIC REGION THEREIN, AND MAGNETIC PARTICLES PREPARED BY THE PROCESS

DETAILED DESCRIPTION OF THE INVENTION

The present invention relates to a process for preparing magnetic particles for use in magnetic recording materials, magnetic printing materials, or the like, and relates particularly to a process for preparing magnetic particles with relatively high stability against oxidation in air as well as high saturation magnetization by oxidizing in an oxidizing gas atmosphere the surfaces of fine particles of a metal selected from the group consisting of iron and iron alloys.

Various methods for preparing particles of a metal selected from the group consisting of iron and iron alloys which have a higher saturation magnetization than the iron oxide particles generally used hitherto as magnetic materials have been developed. The nonacicular particles have been experimentally applied to magnetic toners in order to meet the requirements for rapid and clear copying; on the other hand, the acicular particles having high coercive forces are used as magnetic recording materials and serve to provide the high recording density of magnetic recording media.

The particles with which the present invention is concerned generally have sizes less than 10 to 1 micron and accordingly have high surface activity. Therefore, in the case where the surfaces of the particles consist only of metal, the particles are rapidly oxidized into their cores by an oxygen gas in air, resulting in reduction in their saturation magnetization and coercive fore. The organic solvent has been generally used in order to prevent the rapid oxidation of the particles in the air.

On the other hand, there have been developed various dry processes for converting particles of a metal selected from the group consisting of iron and iron alloys to particles which are relatively stable in air. There is known a method of preparing magnetic particles with a coercive force above 1,300 Oe by oxidizing acicular ferromagnetic metal particles in an atmosphere with a relative humidity of 60 to 90% at a temperature of 40° to 120° C. However, the saturation magnetization of the particles thus obtained is 80 to 130 emu/g, which suggests almost all the part of each particle has been oxidized.

There is also known a method in which Bi, Si, or the like is doped so as to maintain the acicularity of iron particles in the course of heating and reducing acicular $Fe_2O_3$ particles to iron particles, and the surfaces of the thus-doped iron particles are oxidized in a mixture gas of air and $N_2$ or $CO_2$ so as to take out the iron particles into air stably. Some of the particles obtained by this method have a coercive force around 1,220 Oe as well as good acicularity, but the saturation magnetization thereof is about 133 emu/g at its maximum. Other particles obtained by this method have the saturation magnetization around 150 emu/g at maximum. But these particles have relatively small specific surface area because of their degraded acicularity, and their coercive force is 750 to 1,020 Oe. Therefore, the particles obtained by this method are also considered to have been oxidized into their cores to a considerable extent. In addition, the doping of Bi is undesirable from the viewpoint of avoiding public nuisance.

It is an object of the present invention to provide a dry process (using no organic solvent to be immersed and accompanied no liquid-phase reactions) for preparing magnetic particles which consist mainly of a metal selected from the group consisting of iron and iron alloys, can be taken out into air relatively stably without any organic solvent to be immersed, and have a high saturation magnetization, and to provide the magnetic particles prepared by the dry process.

This object can be attained by a process for preparing magnetic particles with metallic regions therein, comprising a first stage of oxidizing surfaces of particles of a metal selected from the group consisting of iron and iron alloys in an atmosphere containing both $H_2O$ and $H_2$ gas at a temperature below 900° C. and a second stage of further oxidizing the surfaces of the particles formed at the first oxidation stage in an atmosphere containing $O_2$ gas.

It is another object of the present invention to provide a dry process for preparing magnetic particles with relatively high stability against oxidation in air and a high saturation magnetization as well as a high coercive force which consist mainly of a metal selected from the group consisting of iron and iron alloys and to provide the magnetic particles prepared by the dry process.

This object can be attained by a process for preparing magnetic particles with metallic regions therein, comprising the first stage of oxidizing the surfaces of a metal selected from the group consisting of iron and iron alloys in an atmosphere containing both $H_2$ and $H_2O$, in which the $H_2O$ concentration defined as ($H_2O$ partial pressure$\times$100)/($H_2O$ partial pressure$+H_2$ partial pressure) is above 10%, at a temperature of 300° to 700° C. and the second stage of further oxidizing the surfaces of the particles formed in the first oxidation stage in an atmosphere containing $O_2$ gas at a temperature below 100° C.

The objects, features and effects of the present invention will be understood more clearly from the following detailed description.

The most conspicuous feature of the present invention is the two-stage oxidation of particles of a metal selected from the group consisting of iron and iron alloys.

In the description of the present invention, the term "metal particles" means particles of a metal selected from the group consisting of iron and iron alloys, and the term "iron alloys" means alloys of iron as a main ingredient with at least one of other metals such as V, Cr, Mn, Co, Ni, Cu, Zn and metals capable of forming solid solutions with iron.

The metal particles may be produced by reducing the metal oxide particles in an atmosphere of a reducing gas such as $H_2$ at a temperature of 350° to 600° C. The metal particles may also be prepared by reducing the metal oxide particles in an aqueous solution and drying the reduced particles in an inert gas. In addition, other methods known per se to obtain metal particles can also be used for the preparation of the metal particles.

The shape of the metal particles is selected according to their use; various shapes such as acicular, cubic and spheric may be adopted.

In the first oxidation stage the metal particles are oxidized in the oxidizing atmosphere containing both $H_2O$ and $H_2$. The first stage of oxidation is based on a hint given by the Fe-$Fe_3O_4$ phase diagram in the atmosphere in which $H_2O$ and $H_2$ coexist, as described in Journal of the Iron and Steel Institute Vol. 160, Page 261 (1948) and J. Chem. Thermodynamics, Vol. 4, Page 60 (1972). It is supposed that a $Fe_3O_4$ layer mainly is formed on the surface of each metal particle at the first oxidation stage.

For relatively rapid oxidation the $H_2O$ concentration is preferably above 10% at the first oxidation stage. Due to the coexistence of $H_2$, however, the $H_2O$ concentration is below 100%. A non-oxidizing gas or gases such as Ar and $N_2$ may be included in the atmosphere. In the case where an inert gas or gases coexist, the term "$H_2O$ concentration" means ($H_2O$ partial pressure$\times$100)/($H_2$ partial pressure+$H_2O$ partial pressure).

According to an industrial viewpoint that it is desirable to complete the first stage of oxidation within a few (2–3) hours for more than 10 kg of the metal particles, the $H_2O$ concentration is preferably above 50%. When the $H_2O$ concentration is above 50%, surface of each metal particle can be uniformly oxidized, and magnetic particles with almost the same magnetic properties can be reproduced. In addition, for avoiding the condensation of $H_2O$ from the atmospheric gases at the outlet of the oxidizing furnace, the $H_2O$ concentration is preferably below 95%. In case of condensation of $H_2O$ at the outlet, the condensed water would flow back into the furnace to adhere to the surfaces of the particles, resulting in the oxidation of the particles deep into their cores. Where acicular magnetic particles are to be prepared, the $H_2O$ concentration is maintained preferably below 90% so as to maintain the acicular shape of the metal particles.

The oxidizing temperature in the first stage is maintained below about 900° C. so as to avoid the phase transition from ferromagnetic $\alpha$-Fe to $\gamma$-Fe. On the other hand, for relatively rapid oxidation, the oxidizing temperature is preferably above 150° C. Further, to complete the first stage of oxidation in a few hours, as mentioned above, the oxidizing temperature is maintained more preferably above 300° C. In addition, it is relatively easy to control the oxidation of the metal particles at the oxidizing temperature above 300° C., and consequently magnetic particles with the same magnetic properties can be reproduced. For avoiding the oxidation of the metal particles deep into their cores, it is preferable to maintain the oxidizing temperature below 700° C. At temperatures between 700° C. and 900° C., the acicularity of the metal particles will be deteriorated; therefore, where acicular magnetic particles are to be prepared, the oxidizing temperature is maintained below 700° C. In the preparation of acicular magnetic particles, to avoid the deterioration of the particle shape due to the formation of FeO which would be caused by slight deviations such as of furnace temperature and concentrations of atmospheric gases from the values to be controlled, by the local variations of oxidizing conditions in the furnace, and the like, it is preferable to maintain the oxidizing temperature below 550° C., from the industrial point of view.

It is thought that an oxide layer consisting mainly of $Fe_3O_4$ is formed on the surface of each metal particle at the first oxidation stage. Since $Fe_3O_4$ has a higher saturation magnetization than $Fe_2O_3$, it is expected that the metal particle with a $Fe_3O_4$ layer thereon has a higher saturation magnetization than the metal particle with only a $Fe_2O_3$ layer thereon. The core of the particle having the oxide layer thereon, is kept in a metal. When the particle is acicular or the like, the metallic region may be distributed in the form of islands in the particle.

When the particles having undergone the first stage of oxidation are taken out into air, the particles will be oxidized rapidly because even the fine $Fe_3O_4$ layer is still active and is exothermically oxidized (Cf. Comparative Example 2). To avoid this, the surfaces of the particles are further oxidized in the second oxidation stage. Since the $Fe_3O_4$ layer which is more stable than the original metal is thought to be formed on the surfaces of the metal particles at the first oxidation stage, it is expected that the magnetic particles can be taken out into air stably by only forming a relatively thin $Fe_2O_3$ layer on the surfaces of the particles produced by the first stage of oxidation at the second oxidation stage.

In the second oxidation stage the surfaces of the particles obtained in the first oxidation stage are further oxidized in a gaseous atmosphere containing $O_2$ to form a $Fe_2O_3$ layer on the surfaces of the particles.

The temperature of the surfaces of the particles in the second oxidation stage is preferably maintained below 100° C. In the case where the particle surface temperature is above 100° C., it is not easy to control the oxidation reaction because the oxidation reaction proceeds rapidly and even the cores of the particles might be oxidized. On oxidation, the progress of the oxidation reaction is controlled by intermittently introducing an oxidizing gas containing $O_2$ or air into the furnace, or by controlling the mixture ratio of $O_2$ or air and an inert gas such as $N_2$, according to the particle surface temperature and oxidation time. In the case of oxidizing over several kilograms of particles, for example, an oxidizing gas at an air/$N_2$ ratio of 1/5 is introduced into the furnace at the biginning, the air proportion in the oxidizing gas is increased with time, and only air is introduced after 2 to 3 hours later. Where the amount of the particles is about a few hundred grams, air may be introduced from the beginning.

To control the progress of the oxidation reaction easily and assuredly by the above-mentioned atmosphere control, it is preferable that the particle surface temperature is maintained below 50° C.

After the second oxidation stage, the particles are converted to particles which can be relatively stable in air.

Also after the second oxidation stage, metal regions are present in the core of the particles.

The following are the effects given by the present invention.

According to the present invention, since the surfaces of the metal particles are coated with an iron oxide layer, the particles is not oxidized rapidly even when taken out in air. Therefore, the process according to the present invention has advantages, from an industrial point of view, in using no costly organic solvents which bring about various difficulties in production process control.

The iron oxide layer formed by the process according to the present invention is thought to consist of $Fe_3O_4$ and $Fe_2O_3$. In addition, since the surfaces of metal particles have been subjected to two-stage oxidation, even when the oxide layer is relatively thin, the metal particles can be taken out into air stably (Cf. Comparative Example 3) and metal regions can be left in the inside of the particles. Therefore, the magnetic particles prepared by the process according to the present invention has the improved magnetic properties as compared to those conventional metal particles which are covered with an iron oxide layer formed by single-stage oxidation.

The magnetization characteristic of the magnetic particles obtained through the process according to the present invention was measured by use of a VSM (Vibrating Sample Magnetometer). The sample particles are packed in a disk-like container (6 mmϕ×2 mm) at an apparent specific gravity of about 1.2 g/cm$^3$ in the measurement.

The magnetic field was directed parallel to the circular plane of the container whose magnetization was negligible.

In the following measurement results, the saturation magnetization $\sigma_s$ is the magnetization at an external magnetic field of 10 kOe at room temperature, the residual magnetization $\sigma_r$ is the magnetization (without shearing) at zero external magnetic field when the external magnetic field has been reduced from 10 kOe to 0 Oe. The coercive force Hc is the magnitude of the external magnetic field at the time when the magnetization is equal to 0 in the course of the change of the external magnetic field from 10 kOe to −10 kOe.

The saturation magnetization of the magnetic particles obtained through the process according to the present invention is over 140 emu/g. When the particles are nonacicular (e.g. cubic) in shape, the saturation magnetization reaches or exceeds 180 emu/g. Therefore, when the nonacicular particles are applied, for example, to magnetic toners, particularly single-component magnetic toner using no carrier, the result lies not only in that the transferring and cleaning properties of the toner can be improved but also in that the concentration of the magnetic particles as a pigment can be largely reduced as compared to the toners of the prior art where $Fe_3O_4$ particles are used, leading to the improvements of various characteristics of the magnetic toner: reduction in toner particles size, improvement of mechanical stability by increasing the proportion of the binder, etc.

When the particles according to this invention are acicular in shape, on the other hand, their coercive force is over 1200 Oe and the saturation magnetization can be 160 emu/g. And the value of $\sigma_r/\sigma_r$ can exceed 0.45. Therefore, the acicular particles are suitable for use in high-recording-density of magnetic recording.

Although the metal particles covered with the oxide layer formed by the present invention can be left relatively stable in air, the oxide layer does not enable semipermanent protection of the metal particles from oxidation; the oxide layer rather prevents the magnetic particle of this invention from "rapid oxidation". Therefore, it is desirable to avoid, as assuredly as possible, the particles being left in an atmosphere containing $O_2$ gas for a long time period or at high temperature.

However, when the particles are blended with various kinds of binders, etc. and applied onto a tape base for forming a magnetic recording medium such as magnetic tape, or applied to form magnetic toner in the resins the particles will not be oxidized further.

The following are more detailed description of the present invention in reference to Examples and Comparative Examples.

EXAMPLE 1

Fe-Co alloy particles were prepared by reducing 200 g of acicular α-FeOOH particles having an average particle size of 0.4 μm (long axis: length along its longitudinal direction) and an axial ratio (length along its longitudinal direction over length perpendicular to the direction) of 10/1 and containing 1% by weight of Co, by stirring the particles in a 10-lit. retort at a temperature of 480° C. and 230 minutes while introducing into the retort the dried $H_2$ gas at a rate of 30 l/min.

Next, the first stage of oxidation was done by introducing a mixture of $H_2$ gas and $H_2O$ gas ($H_2O$ partial pressure: 85%) into the retort at a temperature of 510° C. for 60 minutes. Then, after the retort was cooled to room temperature while introducing $N_2$ gas, the second stage oxidation was done by introducing air into the retort at a rate of 1 l/min. for 90 minutes. In this step, the particle surface temperature was 40° C. at maximum.

After completion of these treatments, the Fe-Co alloy particles covered with iron oxides on their surfaces were taken out into air; no rapid oxidation occurred. The Fe-Co alloy particles covered with iron oxides had an average particle size of 0.3 μm (long axis) and an axial ratio of 7/1. The measurements of their magnetic characteristics revealed that the coercive force Hc was 1,280 Oe, the saturation magnetization $\sigma_s$ was 160 emu/g, and the value of $\sigma_r/\sigma_s$ was 0.492.

EXAMPLES 2–5 and Comparative Example 1

Fe-Co alloy particles covered with iron oxides were prepared in the same way as in Example 1 except that the conditions of the formation of the iron oxide layer were varied. The conditions of the formation of the iron oxide layer together with the magnetic characteristics of the Fe-Co alloy particles covered with the iron oxides obtained under the conditions are shown in Table 1.

The second stage oxidation condition in Example 5 was such that the flow rate of air was 2 l/min. and the air flow was stopped when the temperature had exceeded 70° C. In the second stage oxidation of Comparative Example 1, the flow rate of air was 5 l/min. and the air flow was stopped when the temperature had exceeded 110° C.

EXAMPLE 6

150 g of acicular α-FeOOH particles with an average particle size of 0.4 μm (long axis) and an axial ratio of 10/1 were charged in the same retort as that used in Example 1, and they were reduced in the same way as in Example 1, to form metallic iron particles.

Then the iron oxide layer was formed in the same way as in Example 1, to produce metallic iron particles covered with iron oxides. The conditions of the formation of the iron oxide layer together with the magnetic characteristics are shown in Table 1.

Comparative Example 2

After preparing Fe-Co alloy particles by reduction under the same conditions as in Example 1, the first stage oxidation was done by introducing a mixture of $H_2$ gas and $H_2O$ gas ($H_2O$ partial pressure: 85%) into the retort at a temperature of 420° C. for 60 minutes. Then, after the retort was cooled to room temperature while introducing $N_2$ gas in it, the Fe-Co alloy particles covered with iron oxides on their surfaces were directly taken out of the retort without the second stage oxidation. Particles were exothermically oxidized and turned to red in color.

Comparative Example 3

After preparing Fe-Co alloy particles by reduction under the same conditions as in Example 1, the retort was cooled to room temperature while introducing $N_2$ gas in it. Then, without treatment of the first stage oxidation, only the second stage oxidation was carried out by introducing air into the retort at a rate of 1 l/min. for 90 minutes. After the introduction of air into the retort, the Fe-Co alloy particles were taken out of the retort; after a while, the particles generated heat and turned to red in color.

TABLE 1

| Examples and Comparative Example | First stage oxidation conditions | | | Second stage oxidation conditions | | | Magnetic properties | | |
|---|---|---|---|---|---|---|---|---|---|
| | Temp. (°C.) | $H_2O$ Partial Pressure (%) | Treating time (min.) | Temp. (°C.) | Air flow rate (l/min.) | Treating time (min.) | Hc (Oe) | $\sigma_s$ (emu/g) | $\sigma_r/\sigma_s$ |
| Example 1 | 510 | 85 | 60 | 40 | 1 | 90 | 1280 | 160 | 0.492 |
| Example 2 | 250 | 85 | 120 | 40 | 1 | 90 | 1249 | 156 | 0.483 |
| Example 3 | 420 | 40 | 100 | 40 | 1 | 90 | 1299 | 156 | 0.501 |
| Example 4 | 510 | 30 | 100 | 40 | 1 | 90 | 1257 | 159 | 0.498 |
| Example 5 | 420 | 40 | 100 | 70 | 20 | 120 | 1239 | 151 | 0.477 |
| Example 6 | 420 | 85 | 75 | 40 | 1 | 90 | 1320 | 162 | 0.492 |
| Comparative Example 1 | 420 | 40 | 100 | 110 | 5 | 120 | 512 | 76.5 | 0.327 |

EXAMPLE 7

Metallic iron particles were prepared by reducing 1000 g of cubic $Fe_3O_4$ particles with an average particle size of 0.4 μm, by stirring the $Fe_3O_4$ particles in a 10-lit. retort at a temperature of 520° C. for 360 minutes while introducing the dried $H_2$ gas into the retort at a rate of 30 l/min.

Next, the first stage oxidation was done by raising the temperature to 300° C. and introducing a mixture of $H_2$ gas and $H_2O$ gas ($H_2O$ partial pressure: 90%) into the retort for 60 minutes. Then, after cooling the retort to room temperature while introducing $N_2$ gas into the retort, the second stage oxidation was done by introducing air into the retort at a rate of 1 l/min for 90 minutes. In this step, the particle surface temperature was 40° C. at maximum.

After completion of the treatment the metallic iron particles covered with iron oxides on their surfaces were taken out of the retort. But no rapid oxidation of the particles ocurred. The metallic iron particles covered with iron oxides had an average particle size of 0.4 μm; measurements of their magnetic properties revealed that their coercive force Hc was 1050 Oe, the saturation magnetization $\sigma_s$ was 181 emu/g, and the value of $\sigma_r/\sigma_s$ was 0.06.

EXAMPLES 8-12

Metallic iron oxide particles covered with iron oxides were prepared in the same way as in Example 7 except that the conditions of the formation of the iron oxide layer were varied. The conditions of the formation of the iron oxide layer together with the magnetization characteristics of the metallic iron particles covered with the iron oxides obtained under the conditions are shown in Table 2.

In Examples 8 to 10, use was made of the metallic iron particles prepared by reducing 500 g of the same $Fe_3O_4$ powder as in Example 7 in the same retort as in Example 7 at a temperature of 500° C. for 360 minutes while introducing $H_2$ gas into the retort at a rate of 10 l/min.

In Example 9, use was made of the metallic iron particles prepared by reducing 150 g of the same $Fe_3O_4$ powder as in Example 7 in the same retort as in Example 7 at a temperature of 500° C. for 110 minutes under the same $H_2$-gas introduction condition.

In Example 11, use was made of the Fe-Co alloy powder prepared by reducing 300 g of cubic $Fe_3O_4$ particles, containing 2.5 % by weight of Co and having an average particle size of 0.3 μm, for 270 minutes under the same conditions as in Example 8.

In Example 12, use was made of the Fe-Co alloy particles prepared by reducing 200 g of acicular α-FeOOH particles, containing 1% by weight of Co and having an average particle size of 0.4 μm (long axis) and an axial ratio of 10/1, in the same retort as in Example 7 at a temperature of 480° C. for 230 minutes under the same $H_2$-gas introduction condition.

TABLE 2

| Examples | First stage oxidation conditions | | | Second stage oxidation conditions | | | Magnetic properties | | |
|---|---|---|---|---|---|---|---|---|---|
| | Temp. (°C.) | $H_2O$ partial pressure (%) | Treating time (min) | Temp. (°C.) | Air flow rate (l/min.) | Treating time (min.) | He (Oe) | $\sigma_s$ (emu/g) | $\sigma_r/\sigma_s$ |
| 7 | 300 | 90 | 60 | 40 | 1 | 90 | 105 | 181 | 0.07 |
| 8 | 350 | 90 | 60 | 40 | 1 | 90 | 85 | 190 | 0.06 |
| 9 | 800 | 95 | 15 | 40 | 1 | 60 | 110 | 180 | 0.07 |
| 10 | 250 | 90 | 90 | 40 | 1 | 90 | 98 | 187 | 0.06 |
| 11 | 300 | 90 | 60 | 40 | 1 | 90 | 250 | 190 | 0.10 |
| 12 | 750 | 85 | 60 | 40 | 1 | 90 | 433 | 185 | 0.253 |

What is claimed is:

1. A process of preparing a magnetic particle having a metallic region therein, comprising a first stage of oxidizing a surface of a particle of a metal selected from the group consisting of iron and iron alloys in an atmosphere containing both $H_2$ and $H_2O$ gases at an oxidizing temperature below 900° C. and a second stage of further oxidizing the surfaces of the particles formed at the first oxidation stage in an atmosphere containing $O_2$ gas.

2. The process according to claim 1, wherein a $H_2O$ gas concentration at the first oxidation stage defined as ($H_2O$ partial pressure × 100)/($H_2O$ partial pressure + $H_2$ partial pressure) is above 10%.

3. The process according to claim 2, wherein the oxidizing temperature at the first oxidation stage is above 150° C.

4. The process according to claim 3, wherein the oxidizing temperature at the second oxidation stage is below 100° C.

5. The process according to claim 4, wherein the oxidizing temperature at the first oxidation stage is 300° to 700° C.

6. The process according to claim 5, wherein the metal particle is prepared by reducing a particle of an oxide of the metal in a reducing gas atmosphere.

7. The process according to claim 5, wherein the $H_2O$ concentration at the first oxidation stage is 50 to 95%.

8. The process according to claim 6, wherein the $H_2O$ concentration at the first oxidation stage is 50 to 95%.

9. The process according to any one of claims 5 to 8, wherein the oxidizing temperature at the second oxidation stage is below 50° C.

10. The process according to claim 5, wherein the metal particle is acicular in shape.

11. The process according to claim 10, wherein the $H_2O$ concentration at the first oxidation stage is below 90%.

12. The process according to claim 10, wherein the oxidizing temperature at the first oxidation stage is 300° to 550° C.

13. The process according to claim 11, wherein the oxidizing temperature at the first oxidation stage is 300° to 550° C.

14. The process according to any one of claims 10 to 13, wherein the oxidizing temperature at the second oxidation stage is below 50° C.

15. A fine magnetic particle having a maximum size less than 10 μm, a saturation magnetization over 140 emu/g and high stability against oxidation in air, obtained by a process which comprises a first stage of oxidizing a surface of a fine particle of a metal selected from the group consisting of iron and iron alloys in an atmosphere containing both $H_2$ and $H_2O$ gasses at an oxidizing temperature below 900° C., the maximum size of said metallic particle being less than 10 μm, and a second stage of further oxidizing the surface of the particle formed in the first oxidation stage in an atmosphere containing $O_2$ gas, thus leaving a metallic core region in said particle.

16. The magnetic particle according to claim 15, wherein the $H_2O$ concentration at the first oxidation stage, defined as ($H_2O$ partial pressure$\times$100)/($H_2O$ partial pressure+$H_2$ partial pressure), is 50 to 95%, the oxidizing temperature in the first oxidation stage is 300° to 700° C., and the oxidizing temperature in the second oxidation stage is below 50° C.

17. The magnetic particle according to claim 15 or 16, wherein the magnetic particle is a particle for a magnetic toner.

18. The magnetic particle according to claim 17, wherein the maximum size of the magnetic particle is less than 1 μm.

19. The magnetic particle according to claim 15, wherein the $H_2O$ concentration at the first oxidation stage, defined as ($H_2O$ partial pressure$\times$100)/($H_2O$ partial pressure+$H_2$ partial pressure), is 50 to 90%, the oxidizing temperature in the first oxidation stage is 300° to 550° C., and the oxidizing temperature in the second oxidation stage is below 50° C.

20. The magnetic particle according to claim 19, wherein the magnetic particle is acicular in shape.

21. The magnetic particle according to claim 20, wherein the magnetic particle is a particle for magnetic recording medium.

22. The magnetic particle according to claim 21, wherein the maximum size of said metallic particle is less than 1 μm.

* * * * *